US005084918A

United States Patent [19]

Breining et al.

[11] Patent Number: 5,084,918

[45] Date of Patent: Feb. 4, 1992

[54] INTEGRAL SAFETY HELMET

[75] Inventors: Peter M. Breining, Palo Alto, CA; Stephen H. Watson; Jerome M. Sivesind, both of Mountain View, Calif.; Gerrit Heyl, München, Fed. Rep. of Germany

[73] Assignee: Bayerische Motoren Werke AG, Fed. Rep. of Germany

[21] Appl. No.: 535,502

[22] Filed: Jun. 11, 1990

[51] Int. Cl.[5] ..... A42B 1/08

[52] U.S. Cl. ..... 2/424

[58] Field of Search ..... 2/410, 421, 422, 424, 2/425

[56] References Cited

U.S. PATENT DOCUMENTS

| | | | |
|---|---|---|---|
| 4,290,150 | 9/1981 | Guerre-Berthelot | 2/421 |
| 4,291,418 | 9/1981 | Zeisler | 2/410 |
| 4,532,658 | 8/1985 | Zago | 2/421 |
| 4,766,615 | 8/1988 | Morin et al. | 2/421 |
| 4,769,857 | 9/1988 | Cianfanelli et al. | 2/424 |

FOREIGN PATENT DOCUMENTS

| | | | |
|---|---|---|---|
| 72767 | 2/1983 | European Pat. Off. | 2/410 |
| 134183 | 3/1985 | European Pat. Off. | 2/410 |
| 0258496 | 8/1986 | European Pat. Off. . | |
| 2937356 | 4/1980 | Fed. Rep. of Germany | 2/424 |
| 2846636 | 4/1981 | Fed. Rep. of Germany . | |
| 2542170 | 9/1984 | France | 2/410 |
| 2119229 | 11/1983 | United Kingdom | 2/421 |

OTHER PUBLICATIONS

Sep. 1988, DM 4,50, Motarrad-Magazin Heft 9.

*Primary Examiner*—Werner H. Schroeder
*Assistant Examiner*—Michael A. Neas
*Attorney, Agent, or Firm*—Evenson, Wands, Edwards, Lenahan & McKeown

[57] ABSTRACT

An integral safety helmet is described in which a chin guard can be folded up. For the release of the chin guard, a central opening bar is provided on the front side of the chin guard. As a result, the locking mechanism can easily be opened by only one hand or by the thumb of the motorcyclist. In certain embodiments, the opening bar is designed as a two-armed lever having an upper arm and a lower lever arm. In this manner, the chin piece can be released in two different manners.

33 Claims, 4 Drawing Sheets

INTEGRAL SAFETY HELMET

BACKGROUND AND SUMMARY OF THE INVENTION

The invention relates to an integral safety helmet, particularly for motorcyclists, having a cap-shaped helmet bowl surrounding the head of the wearer of the helmet and having a chin guard reaching over the lower-jaw part of the head, this chin guard being connected to the helmet bowl in an upwardly pivotable manner and being locked with the helmet bowl in the folded-down state.

A safety helmet of this general type is known from the German Patent Document DE-PS 28 46 636. It comprises a helmet bowl to which a chin piece is pivotally connected. When closing the helmet, the wearer of the helmet folds the chin piece downward which, in this position, is automatically locked with the helmet bowl by way of a locking mechanism. When the wearer of the helmet wants to remove the safety helmet, he presses two push lateral bars which release the chin piece. The wearer of the helmet can then swivel the chin piece upward and thus remove the safety helmet.

The operating of the two lateral push bars is awkward. It requires the wearer to have both hands free since it is not possible to operate both push bars with one hand.

It is an object of the invention to further develop this type of a known integral safety helmet in such a manner that the release and the swivelling-up of the chin piece can take place more easily.

According to the invention, this object is achieved by providing a helmet construction wherein an opening bar is provided at the front side of the chin guard for its release, and wherein the operating direction of the opening bar extends upwards in the swivelling direction of the chin guard.

By means of a central opening bar on the front side of the chin piece in preferred embodiments of the invention, the wearer of the helmet can operate this bar with only one hand. Since, for the removal of the helmet, the chin guard must first be swivelled upward, it is another characteristic of the invention to adapt the operating direction for the opening bar to this swivel movement. In this manner, the wearer of the helmet swivels the chin guard upward simultaneously with the operating of the opening bar.

Advantageously, the opening bar is connected with a locking mechanism by way of a cable pull.

In an advantageous embodiment, the opening bar is constructed as the operating lever which is arranged approximately vertically on the front side of the chin guard. In this case, its upper end section is disposed in an axis of rotation provided at the chin guard. The lower end section of the opening bar has a molded-out part that is easy to grip.

It is advantageous according to certain preferred embodiments to hold the opening bar in its initial position by way of spring force; i.e., in the position in which the chin guard is locked to the helmet bowl.

According to certain preferred embodiemnts, the ease of release and swivelling up of the chin guard is enhanced by providing a helmet wherein the opening bar is constructed as a two-armed lever including a lower lever arm and an upper lever arm, which two lever arms are arranged at the chin piece for pivotal movement around a horizontal axis, the lower lever arm permitting the operating direction in the swivelling direction of the chin piece, and the upper lever arm being operable as a push bar.

According to the two-armed lever embodiments of the invention, the opening bar is therefore designed as a two-armed lever which is disposed in the center at the chin guard. In this manner, a combined pull/push bar is obtained. In this case, the lower lever arm should be considered to be the pull bar because it is gripped from behind and pulled toward the front. The upper lever arm represents the push bar because, during the operation, it is pushed against the chin guard. By means of this development of the opening bar, the wearer of the helmet can release the chin guard in two different ways.

In the case of an impact, the chin guard should not be released automatically. It is therefore expedient for the opening bar to be arranged in a sunk manner inside the chin guard.

The restoring of the opening bar into the initial position, in which therefore the folded-down chin guard is interlocked with the helmet bowl, advantageously takes place by means of a pressure spring arranged between the push bar part or the upper lever arm and the wall of the chin piece.

The opening bar operates the locking mechanism of the chin guard by way of a cable pull or a rod linkage. In this case, the locking mechanism may have different constructions. In an advantageous embodiment, it comprises a mushroomhead-shaped locking pin which is fixed at the helmet bowl. When the chin guard is closed, a catch spring engages in this locking pin and is fixed at the chin guard and operated by way of the cable pull. The type of operation may also differ. Advantageously, a release lever may be provided for this purpose which is disposed inside the lateral wall of the chin guard and presses on the catch spring against the spring force. In a particularly simple embodiment, this release lever is at the same time designed as the spring element and, as a single component, also takes over the function of the catch spring.

Other objects, advantages and novel features of the present invention will become apparent from the following detailed description of the invention when considered in conjunction with the accompanying drawings.

DETAILED DESCRIPTION OF THE DRAWINGS

Figure 1:
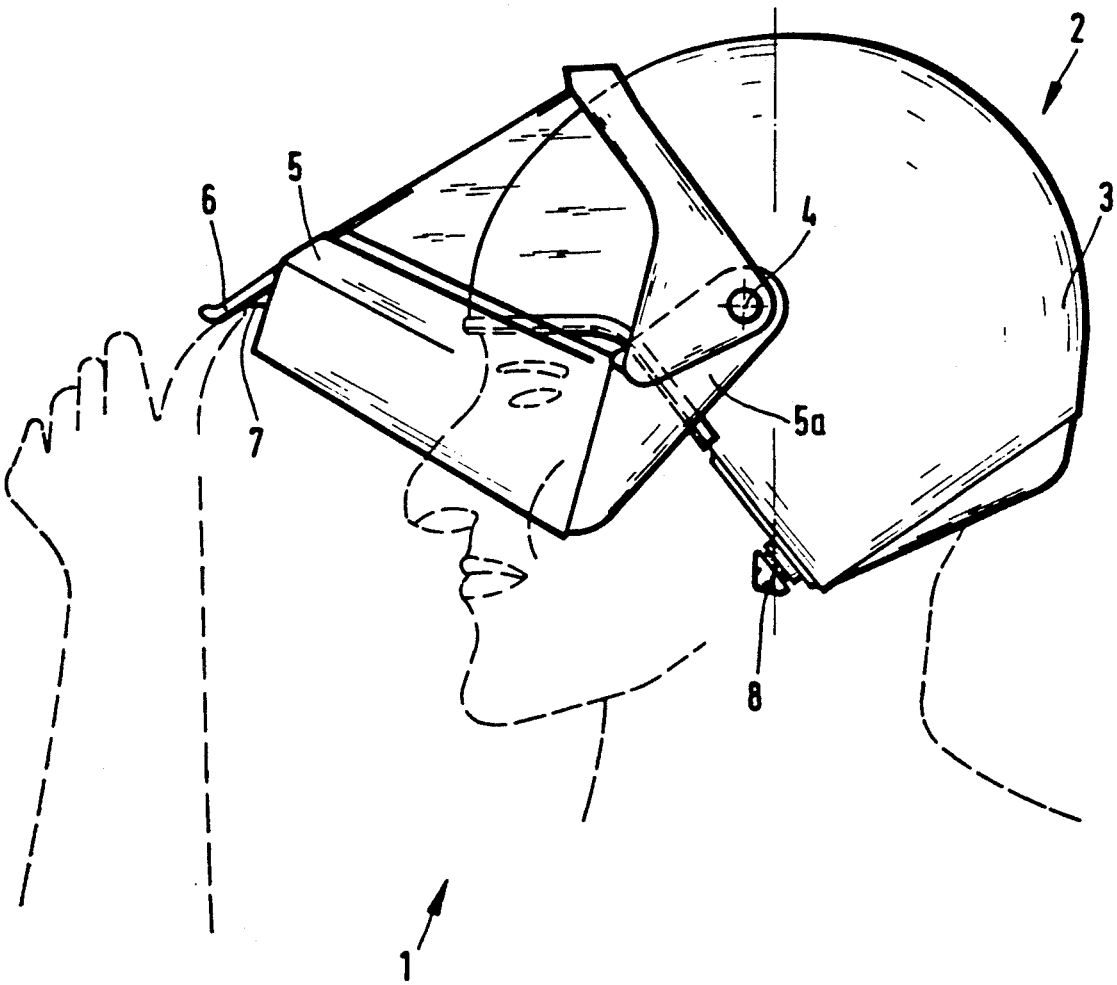
FIG. 1 is a schematic view showing a safety helmet at the moment when the wearer of the helmet swivels up the chin guard, constructed according to a preferred embodiment of the invention.

FIG. 1 shows a motorcyclist 1 wearing an integral safety helmet 2. The safety helmet 2 comprises a cap-shaped helmet bowl 3 surrounding the head of the motorcyclist 1. The helmet bowl 3 holds a ching guard 5 in a pivotable manner by way of respective hinges 4 arranged on both sides, only one of these hinges 4 being visible in FIG. 1, a similar one being disposed at the opposite side of the helmet.

The chin guard 5 is molded in a predetermined shape to accommodate the lower-jaw area of the motorcyclist and therefore reaches over this area approximately in the shape of an elliptical half-shell. Its end sections 5*a* extend upward at an angle and are disposed in the axes of the hinges 4.

The motorcyclist according to FIG. 1 is in the process of removing the helmet. For this purpose, his thumb has gripped an opening bar 6 arranged at the front side of the chin guard 5 from below and pressed it upward. By way of a cable pull 7, the opening bar 6 acts upon a locking mechanism by means of which the folded-down chin guard 5 is locked at the helmet bowl 3. When the motorcyclist 1 exercises further pressure on the opening bar 6, the chin guard 5 swivels upward into the position shown in FIG. 1 by way of the hinges 4. In this position, the motorcyclist 1 can remove the helmet.

Figure 2:
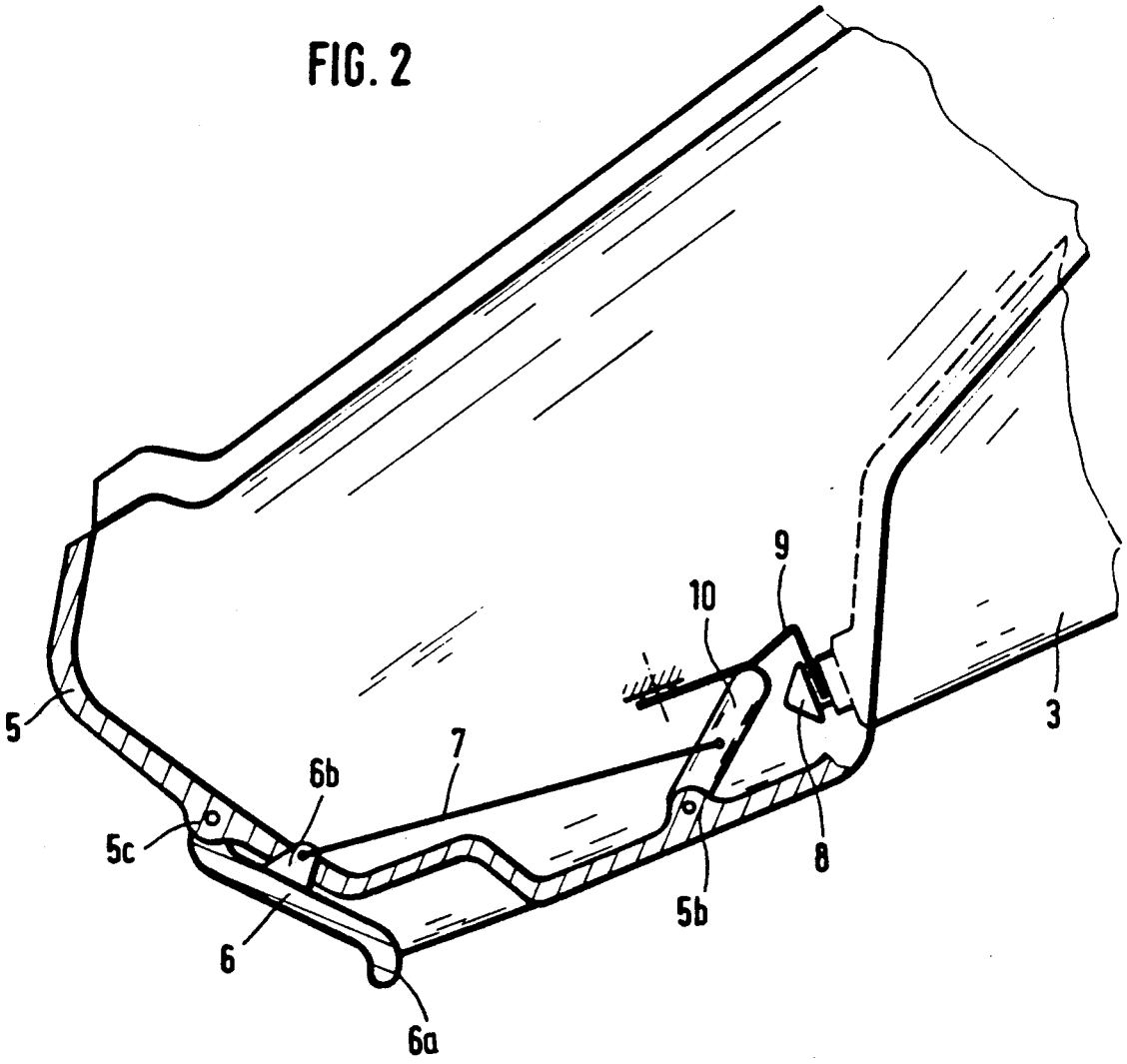
FIG. 2 is an enlarged sectional representation of a segment of the safety helmet according to FIG. 1 in which the chin guard is folded down and locked.

FIG. 2 is a view of an enlarged lower segment of the safety helmet 2. The chin guard 5 which is shown in a sectional view, in contrast to FIG. 1, is folded down and is locked at the helmet bowl 3. A locking mechanism is provided on each side of the helmet, but because of the type of representation in FIG. 2, only one is visible. Each locking mechanism comprises a mushroomhead-shaped locking pin 8 of the helmet bowl 3. A catch spring 9 which is fastened to the chin guard 5 with one end reaches behind the locking pin 8. The chin guard 5 also receives a release lever 10 which is pivotably mounted on a bearing lug 5*b*. Release lever 10 presses against the freely projecting section of the catch spring 9 and against its spring force. An end of the cable pull 7 is fastened to the release lever 10 and the other end leads to the opening bar 6, as described more fully in conjunction with FIGS. 3 and 4.

Figure 3:
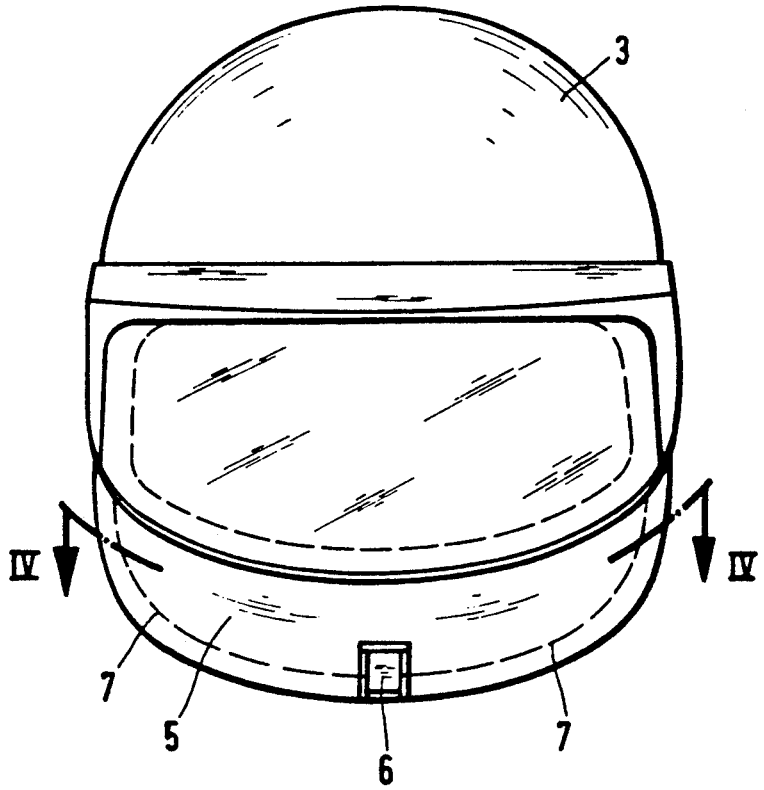
FIG. 3 is a schematic front view of the safety helmet of FIGS. 1 and 2 with a closed chin guard.
Figure 4:
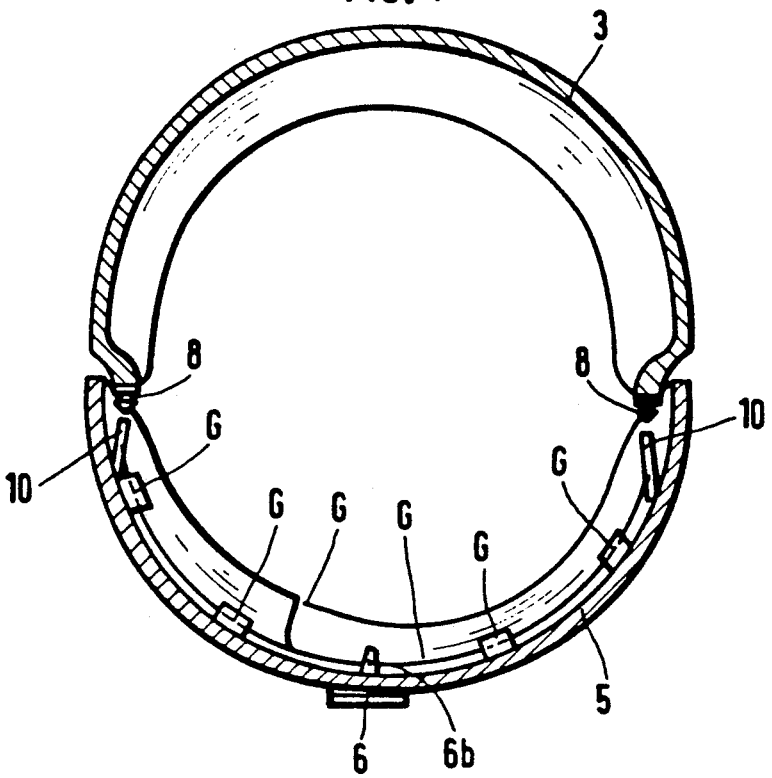
FIG. 4 is a schematic sectional view taken along line IV—IV of FIG. 3.

In FIGS. 1 and 2, the cable 7 is shown only schematically. FIGS. 3 and 4 illustrate the guidance of the cable 7 in guides G disposed along the interior side of the chin guard. Thus the cable 7 is guided at the actuating opening bar 6 by way of fastening lug 6*b* and then through the guides G to the respective release levers 10 at the sides of the helmet. To aid in illustration of the guidance of the cable 7, the catch springs 9 are not illustrated in FIGS. 3 and 4.

As clearly shown in FIG. 2, the opening bar 6 is disposed on the front side of the chin guard 5. It is constructed as an oblong lever and is aligned at the chin guard 5 approximately vertically when the chin guard is viewed from the front. With its upper end, the opening bar 6 is disposed in a bearing lug 5*c* of the chin guard 5 so that it can be swivelled upward by way of an approximately horizontally extending axis, again when the chin guard is viewed from the front. At its lower end section, the opening bar 6 has a molded-out part 6*a* which is easy to grip. The chin guard 5 has an indentation at this point which makes it possible for the motorcyclist to reach behind the opening bar 6 with his thumb and press it toward the front. Finally, a fastening lug 6*b* projects away from the opening bar 6 at which the end of the cable pull 7 is suspended and leads from there to the locking mechanism on the other side which is not shown in FIG. 2. In this case, the fastening lug 6*b* extends through a breakthrough of the chin guard 5.

For the release of the chin guard, the motorcyclist (as also shown in FIG. 1) must only press his thumb from behind against section 6*a* of the opening bar 6. The opening bar 6 will then turn upward and, by way of the cable pull 7, will pull the obliquely set release lever 10 toward itself. These release levers 10 press the respective catch springs out of the respective locking pins 8 against spring force. When the pressure is maintained, the chin guard 5 will then swivel upward in the manner shown in FIG. 1.

On the other hand, as soon as the motorcyclist releases the opening bar 6, the spring force of the catch springs 9 causes a restoring of the opening bar 6.

Figure 5:
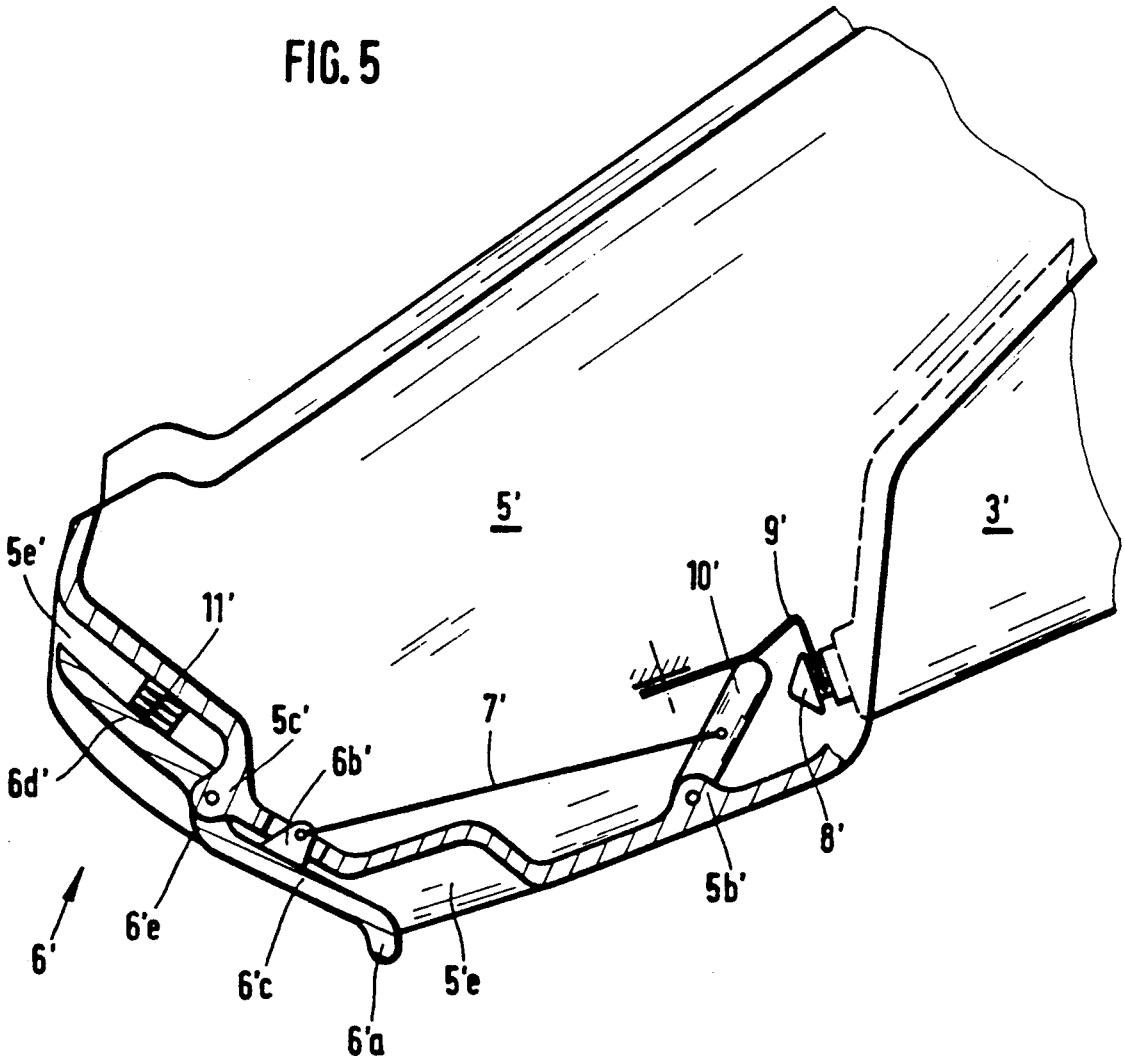
FIG. 5 is a view similar to FIG. 2 showing another preferred embodiment of a chin guard locking and release mechanism which uses a two-armed lever.

FIG. 5 shows another embodiment of a chin guard locking and release mechanism. In FIG. 5, corresponding "' (primed)" reference numerals are used to designate structure generally corresponding to similiarly numbered structure of FIGS. 1–4.

FIG. 5 is a view of an enlarged lower segment of the safety helmet 2'. The chin guard 5', which is shown in a sectional view, in contrast to FIG. 1, is folded down and is locked at the helmet bowl 3'. A locking mechanism is provided on each side of the helmet, but because of the type of representation in FIG. 5, only one is visible. Each locking mechanism comprises a mushroomhead-shaped locking pin 8' of the helmet bowl 3'. A catch spring 9' is fastened with one end to, the chin guard 5' and reaches behind the locking pin 8'. The chin guard 5' also receives a release lever 10' pivotally mounted on a bearing lug 5*b*'. Release lever 10' presses against the freely projecting section of the catch spring 9' and against its spring force. An end of the cable pull 7' is fastened to the release lever, 10' and the other end leads to the opening bar 6', as described more fully in conjunction with FIGS. 3 and 4.

In FIG. 5, the cable 7' is shown only schematically. FIGS. 3 and 4 illustrate the guidance of the cable in guides G disposed along the interior side of the chin guard, as described above the the FIGS. 1 and 2 embodiments.

The opening bar 6' is constructed as a two-armed lever having a lower lever arm 6*c*' and an upper lever arm 6*d*'. By means of its center section 6*e*', it is pivotally disposed on a bearing lug 5*c*' of the chin guard 5'. In a view from the front toward the helmet, the swivel axis extends in a horizontal manner, while the opening bar 6'—viewed in the same direction—is aligned approximately vertically at the chin piece. Particularly, the upper lever arm 6*d*'. is disposed in an indentation 5*e*' which is worked into the contour of the front side of the chin piece 5'. As a result, the upper lever arm 6*d*' is protected from an unintentional operation in the case of an impact. A pressure spring 11' which presses the lever into the illustrated position is disposed between the wall of the chin piece and the rear of the lever arm 6*d*'.

At its free end section, the lower lever arm 6*c*' has a molded-out part 6*a*' which is easy to grip. At this point, the indentation 5*e*' in the chin guard 5' recedes further. As a result, the motorcyclist has sufficient space in order to reach with his thumb behind the lower lever arm 6*c*' and to swivel the opening bar 6' toward the front.

On the rear of the lower lever arm 6*c*', a fastening lug 6*b*' is provided which extends through an opening in the chin guard wall 5' into the inside. There, it receives the cable pull 7'. To complete the picture, it should be mentioned that a locking mechanism is provided on each side of the helmet, and that the cable pull 7' extends from the one release lever 10' through the fastening leg 6b' to the release lever on the other side.

The chin guard 5' can be released in two different manners. In a normal case, the motorcyclist would reach with his thumb—as shown in FIG. 1—into the molded-out part 6a' of the lower lever arm 6c' and press the opening bar 6' into the swivel direction upwards. By means of the cable pull 7', the opening bar 6' pulls the obliquely set release lever 10' toward itself which erects itself as a result of its pivotable bearing. It presses the catch spring 9' out of the locking pin 8'. When the operating force on the lower lever arm 6c' is continued, the chin piece 5', as a whole, corresponding to FIG. 1, is swivelled upward.

The second possibility to release the chin piece 5' takes place by way of the upper lever arm 6d'. By means of a simple pressing against the force of the spring 11', the locking mechanism can be released by means of the locking pin 8' and the catch spring 9'. However, in this type of an operation, the motorcyclist must also carry out a conscious swivel motion of the chin piece 5' in upward direction. Advantageously, the word "press" may be written on the visible surface of the upper lever arm 6d'.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An integral safety helmet, particularly for motorcyclists, having a cap-shaped helmet bowl for surrounding a head of a wearer of the helmet and having a chin guard reaching over a lower-jaw part of the head, and connecting means for connecting this chin guard to the helmet bowl in an upwardly pivotable manner and for locking this chin guard with the helmet bowl in the folded-down state, wherein an opening bar is provided at the front side of the chin guard for releasing the chin guard, wherein the operating direction of the opening bar extends upwards in the swivelling direction of the chin guard, and wherein a resilient locking device is provided to hold the chin guard in its locked position in such a manner that it is automatically releasable in response to movement of the opening bar upwards.

2. A safety helmet according to claim 1, wherein the opening bar operates a locking mechanism by way of a cable pull.

3. A safety helmet according to claim 1, wherein the opening bar is constructed as an approximately vertically aligned lever which, by means of an upper end section is connected to the chin guard pivotally around an approximately horizontally extending axis, and wherein a lower end section of the lever is disposed adjacent a molded-out part of the chin guard which is configured to accommodate easy gripping of the lever by the wearer's thumb.

4. A safety helmet according to claim 2, wherein the opening bar is constructed as an approximately vertically aligned lever which is connected by means of an upper end section to the chin guard pivotally for movement around an approximately horizontally extending axis, and wherein a lower end section of the lever is disposed adjacent a molded-out part which is configured to accommodate easy gripping of the lever by the wearer's thumb.

5. A safety helmet according to claim 1, wherein the opening bar is held in its initial position by spring force.

6. A safety helmet according to claim 2, wherein the opening bar is held in its initial position by spring force.

7. A safety helmet according to claim 3, wherein the opening bar is held in it initial position by spring force.

8. A safety helmet according to claim 4, wherein the opening bar is held in its initial position by spring force.

9. A safety helmet according to claim 1, wherein the opening bar is disposed substantially in the center of the helmet to accommodate one hand operation of the opening bar by the motorcycle operator.

10. A safety helmet according to claim 1, wherein the opening bar is constructed as a two-armed lever including a lower lever arm and an upper lever arm, which two-armed lever is arranged at the chin guard for pivotal movement around a horizontal axis, the lower lever arm permitting the operating in the swivelling direction of the chin guard, and the upper lever arm being operable as a push bar.

11. A safety helmet according to claim 10, wherein the opening bar is arranged in an indentation of the chin guard.

12. A safety helmet according to claim 10, wherein a pressure spring is arranged between the chin guard and the upper lever arm.

13. A safety helmet according to claim 11, wherein a pressure spring is arranged between the chin guard and the upper lever arm.

14. A safety helmet according to claim 10, wherein, for the locking of the chin guard, the helmet bowl has at least one mushroomhead-shaped locking pin in which a catch spring ca engage which can be acted upon by the opening bar and is fixed at the chin guard.

15. A safety helmet according to claim 11, wherein, for the locking of the chin guard, the helmet bowl has at least one mushroomhead-shaped locking pin in which a catch spring can engage which can be acted upon by the opening bar and is fixed at the chin guard.

16. A safety helmet according to claim 12, wherein, for the locking of the chin guard, the helmet bowl has at least one mushroomhead-shaped locking pin in which a catch spring can engage which can be acted upon by the opening bar and is fixed at the chin guard.

17. A safety helmet according to claim 13, wherein, for the locking of the chin guard, the helmet bowl has at least one mushroomhead-shaped locking pin in which a catch spring can engage which can be acted upon by the opening bar and is fixed at the chin guard.

18. A safety helmet according to claim 10, wherein the opening bar is disposed substantially in the center of the helmet to accommodate one hand operation of the opening bar by the motorcycle operator.

19. An integral safety helmet, particularly for motorcyclists, having a cap-shaped helmet bowl for surrounding a head of a wearer of the helmet and having a chin guard reaching over a lower-jaw part of the head, and connecting means for connecting this chin guard to the helmet bowl in an upwardly pivotable manner and for locking this chin guard with the helmet bowl in the folded-down state, wherein an opening bar is provided at the front side of the chin guard for releasing the chin guard, wherein the operating direction of the opening bar extends upwards in the swivelling direction of the chin guard, and wherein the opening bar operates a locking mechanism by way of a cable pull.

20. A safety helmet according to claim 19, wherein the opening bar is constructed as an approximately vertically aligned lever which, by means of an upper end section is connected to the chin guard pivotally around an approximately horizontally extending axis, and wherein a lower end section of the lever is disposed adjacent a molded-out part of the chin guard which is configured to accommodate easy gripping of the lever by the wearer's thumb.

21. A safety helmet according to claim 19, wherein the opening bar is held in its initial position by spring force.

22. A safety helmet according to claim 20, wherein the opening bar is held in its initial position by spring force.

23. An integral safety helmet, particularly for motorcyclists, having a cap-shaped helmet bowl for surrounding a head of a wearer of the helmet and having a chin guard reaching over a lower-jaw part of the head, and connecting means for connecting this chin guard to the helmet bowl in an upwardly pivotable manner and for locking this chin guard with the helmet bowl in the folded-down state, wherein an opening bar is provided at the front side of the chin guard for releasing the chin guard, wherein the operating direction of the opening bar extends upwards in the swivelling direction of the chin guard, wherein the opening bar is constructed as an approximately vertically aligned lever which, by means of an upper end section is connected to the chin guard pivotally around an approximately horizontally extending axis, and wherein a lower end section of the lever is disposed adjacent a molded-cut part of the chin guard which is configured to accommodate easy gripping of the lever by the wearer's thumb.

24. A safety helmet according to claim 23, wherein the opening bar is held in its initial position by spring force.

25. An integral safety helmet, particularly for motorcyclists, having a cap-shaped helmet bowl for surrounding a head of a wearer of the helmet and having a chin guard reaching over a lower-jaw part of the head, and connecting means for connecting this chin guard to the helmet bowl in an upwardly pivotable manner and for locking this chin guard with the helmet bowl in the folded-down state, wherein an opening bar is provided at the front side of the chin guard for releasing the chin guard, wherein the operating direction of the opening bar extends upwards in the swivelling direction of the chin guard, wherein the opening bar is constructed as a two-armed lever including a lower lever arm and an upper arm, which two-armed lever is arranged at the chin guard for pivotal movement around a horizontal axis, the lower lever arm permitting the operating in the swivelling direction of the chin guard, and the upper lever arm being operable as a push bar.

26. A safety helmet according to claim 25, wherein the opening bar is arranged in an indentation of the chin guard.

27. A safety helmet according to claim 25, wherein a pressure spring is arranged between the chin guard and the upper lever arm.

28. A safety helmet according to claim 26, wherein a pressure spring is arranged between the chin guard and the upper lever arm.

29. A safety helmet according to claim 25, wherein, for the locking of the chin guard, the helmet bowl has at least one mushroomhead-shaped locking pin in which a catch spring can engage which can be acted upon by the opening bar and is fixed at the chin guard.

30. A safety helmet according to claim 26, wherein, for the locking of the chin guard, the helmet bowl has at least one mushroomhead-shaped locking pin in which a catch spring can engage which can be acted upon by the opening bar and is fixed at the chin guard.

31. A safety helmet according to claim 27, wherein, for the locking of the chin guard, the helmet bowl has at least one mushroomhead-shaped locking pin in which a catch spring can engage which can be acted upon by the opening bar and is fixed at the chin guard.

32. A safety helmet according to claim 28, wherein, for the locking of the chin guard, helmet bowl has at least one mushroomhead-shaped locking pin in which a catch spring can engage which can be acted upon by the opening bar and is fixed at the chin guard.

33. A safety helmet according to claim 25, wherein the opening bar is disposed substantially in the center of the helmet to accommodate one hand operation of the opening bar by the motorcycle operator.

* * * * *